US006021717A

United States Patent [19]

Theurer

[11] Patent Number: 6,021,717

[45] Date of Patent: Feb. 8, 2000

[54] MACHINE FOR COMPACTING AND SHAPING A TRACK BED

[75] Inventor: Josef Theurer, Vienna, Austria

[73] Assignee: Franz Plasser Bahnbaumaschinen Industriegesellschaft m.b.H., Vienna, Australia

[21] Appl. No.: 09/086,755

[22] Filed: May 29, 1998

[30] Foreign Application Priority Data

Jun. 27, 1997 [AT] Austria ..... 1107/97

[51] Int. Cl.[7] ..... E01B 29/00

[52] U.S. Cl. ..... 104/2; 37/104

[58] Field of Search ..... 104/2, 7.1, 7.2, 104/7.3, 10, 12; 37/104, 105

[56] References Cited

U.S. PATENT DOCUMENTS 4,064,807 12/1977 Theurer .
4,881,467 11/1989 Theurer ..... 104/12
4,953,467 9/1990 Theurer ..... 104/7.1
5,172,635 12/1992 Theurer .
5,172,637 12/1992 Theurer .
5,660,112 8/1997 Theurer ..... 104/2

FOREIGN PATENT DOCUMENTS 2 267 305 12/1993 United Kingdom .

*Primary Examiner*—Mark T. Le
*Attorney, Agent, or Firm*—Collard & Roe, PC

[57] ABSTRACT

A machine for compacting and shaping a ballast bed comprises a machine frame supported on undercarriages on a track for mobility in an operating direction, a vertically adjustable track stabilization assembly including a vibrator for generating horizontal oscillations extending transversely to the longitudinal direction and flanged rollers engaging, and running on, the track rails, drives linking the track stabilization assembly to the machine frame for vertically adjusting the track stabilization assembly, and a vertically adjustable plow for profiling the ballast, the plow being affixed directly to the track stabilization assembly to form a structural unit therewith.

4 Claims, 2 Drawing Sheets

MACHINE FOR COMPACTING AND SHAPING A TRACK BED

BACKGROUND OF THE INVENTION

1. Field of the Invention

The present invention relates to a machine for compacting and shaping a ballast bed supporting a track having two rails, which comprises a machine frame extending in a longitudinal direction and supported on undercarriages on the track for mobility in an operating direction, a vertically adjustable track stabilization assembly including vibrating means for generating horizontal oscillations extending transversely to the longitudinal direction and flanged rollers engaging, and running on, the track rails, drive means linking the track stabilization assembly to the machine frame for vertically adjusting the track stabilization assembly, and a vertically adjustable plow for profiling the ballast.

2. Description of the Prior Art

Machines of this general type are known from U.S. Pat. Nos. 5,172,635 and 5,172,637. In these machines, the vertically adjustable plow for profiling the ballast is arranged forwardly of a track stabilization assembly in the operating direction and is spaced therefrom. These machines advantageously enable the ballast to be compacted and profiled in a desired manner while artificially anticipating the initial settling of the ballast after a track surfacing operation.

It is known from U.S. Pat. No. 4,064,807 to arrange a vertically adjustable plow for profiling the ballast forwardly of a track stabilization assembly underneath a raised track section to plane the track bed and raise the track level.

According to British patent No. 2,267,305, a track lifting unit in a ballast cleaning machine is combined with a crank drive to generate transversely extending, horizontal oscillations. This enables the cleaned ballast to be compacted to stabilize the track bed.

SUMMARY OF THE INVENTION

It is the primary object of this invention to improve a machine of the first-described type by providing a better ballast movement.

The above and other objects are accomplished according to the invention in such a machine by affixing the plow directly to the track stabilization assembly to form a structural unit therewith.

This combination of the track stabilization assembly with the ballast plow in a structural unit enables the plow to oscillate with the track stabilization assembly. This enhances the sliding and flowing tendency of the ballast so that the ballast is distributed without problems and with a reduced energy consumption even when larger piles of ballast are encountered.

BRIEF DESCRIPTION OF THE DRAWING

The above and other objects, advantages and features of the present invention will become more apparent from the following detailed description of certain now preferred embodiments thereof, taken in conjunction with the accompanying drawing wherein.

DETAILED DESCRIPTION OF THE PREFERRED EMBODIMENTS

Figure 1:
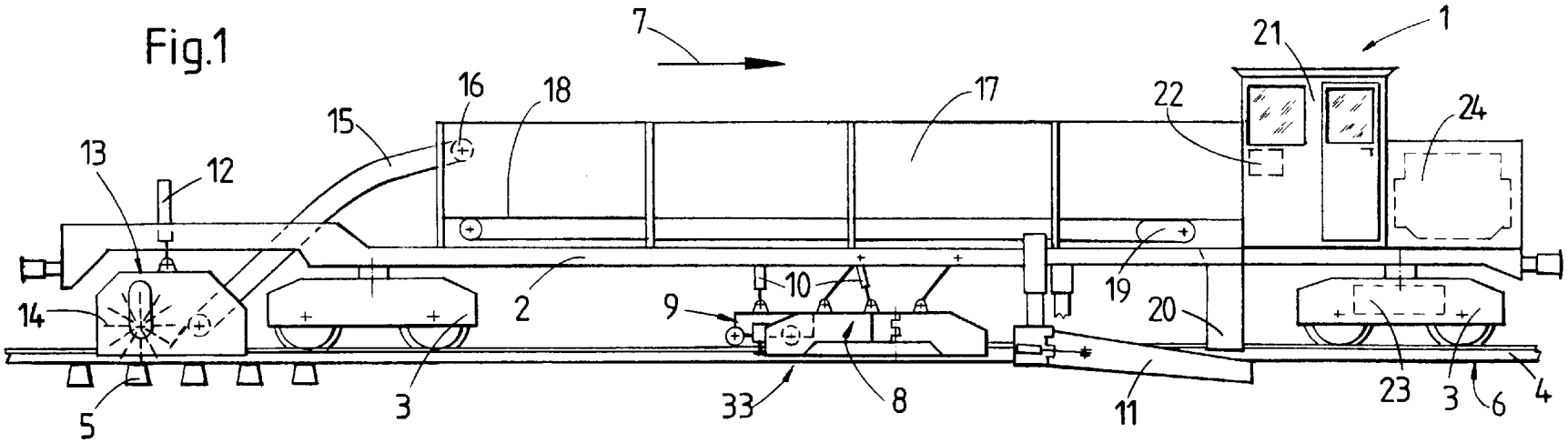
FIG. 1 shows a side elevational view of one embodiment of a machine for compacting and shaping a ballast bed according to this invention.
Figure 2:
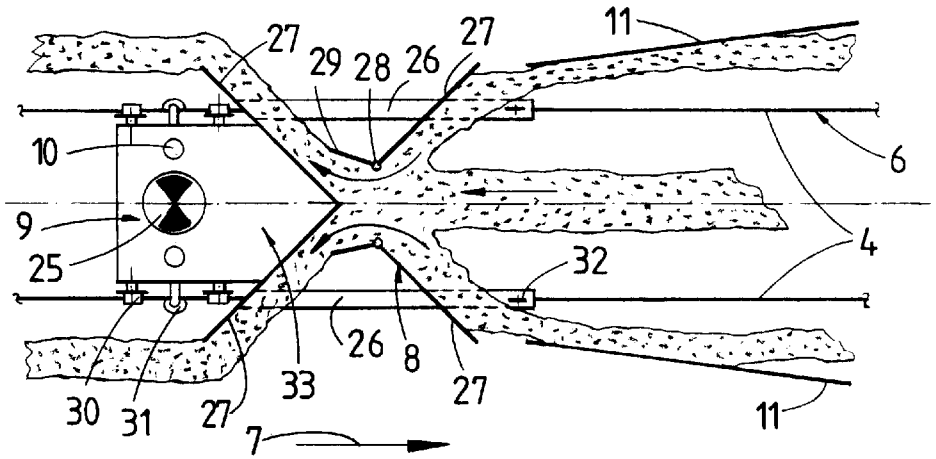
FIG. 2 is a simplified and schematicized top view of the structural unit of the invention, shown in FIG. 1, and illustrating the ballast flow.

Referring now to the drawing, FIGS. 1 and 2 show machine 1 for compacting and shaping a ballast bed supporting track 6 having two rails 4 fastened to ties 5. The illustrated machine comprises machine frame 2 extending in a longitudinal direction and supported on undercarriages 3 on track 6 for mobility in an operating direction indicated by arrow 7. Vertically adjustable track stabilization assembly 9 is mounted underneath machine frame 2 between undercarriages 3 and includes vibrator 25 for generating horizontal oscillations extending transversely to the longitudinal direction and flanged rollers 30 engaging, and running on, track rails 4. The flanged rollers engage the gage sides of rails 4 without play, and transversely pivotal rollers 31 subtend the heads of rails 4 to hold the track rails firmly between rollers 31 and the flanges of flanged rollers 30. Drives 10 link track stabilization assembly 9 to machine frame 2 for vertically adjusting the track stabilization assembly. Vertically adjustable plow 8 for profiling the ballast is affixed directly to track stabilization assembly 9 to form structural unit 33 therewith.

As best shown in FIG. 2, plow 8 is a center plow designed to plow the ballast in the area of the track, and essentially consists of two ballast guide plowshares 27 extending forwardly at an angle to the longitudinal direction and connected to rail tunnels 26, as well as two central ballast guide plowshares 29 extending rearwardly and being pivotal about vertical axis 28. Structural unit 33 is further supported on track rails 4 by flanged rollers 32 at the forward ends of rail tunnels 26.

Two shoulder plows 11 precede plow 8 in the operating direction. The shoulder plows extend in the longitudinal direction and are transversely spaced from each other. They are vertically and transversely adjustable by suitable drives so that they may move ballast inwardly from the shoulders into the area of the track, if needed. As shown in FIG. 1, plow 8 is arranged forwardly of track stabilization assembly 9 in the operating direction.

Ballast broom-conveyor installation 13 is mounted at the rear end of machine frame 2, seen in the operating direction. It comprises rotatable ballast broom 14 arranged to sweep ballast onto conveyor band 15 preceding the broom in the operating direction, and output end 16 of the conveyor band is arranged to discharge swept-up ballast into ballast silo 17 mounted on machine frame 2. The bottom of ballast silo 17 is constituted by conveyor band 18 extending over the entire width of the silo, and the conveyor band can be revolved by drive 19 to convey ballast stored in the silo to discharge chutes 20 for distribution at targeted locations of the ballast bed. Driver's and operator's cab 21 houses central control 22 for operating the drives of the machine. Power plant 24 is arranged to provide power for the drives, including drive 23 for moving machine 1 along the track.

As indicated in FIG. 2, by suitably adjusting the positions of central ballast guide plowshares 29 and/or shoulder plows 11, ballast may be moved in different directions between the center of the track bed and the track shoulders. Since plow

8 forms a structural unit with track stabilization assembly 9, the horizontal oscillations generated by vibrator 25 are transmitted to the ballast stones guided by plowshares 27 and 29 of plow 8 so that the flow of ballast moved by plow 8 is considerably enhanced. At the same time, the horizontal oscillations of track stabilization assembly 9 and the static vertical load applied thereto by drives 10 will continuously subject the ballast bed to controlled compaction and settle it at a desired level. The control of this ballast bed settling operation is obtained by a reference system not further described herein since it has been fully disclosed in the first-named U.S. patents. It forms part of the prior art, as do various structural details of the track stabilization assembly and plow not further described herein.

Figure 3:
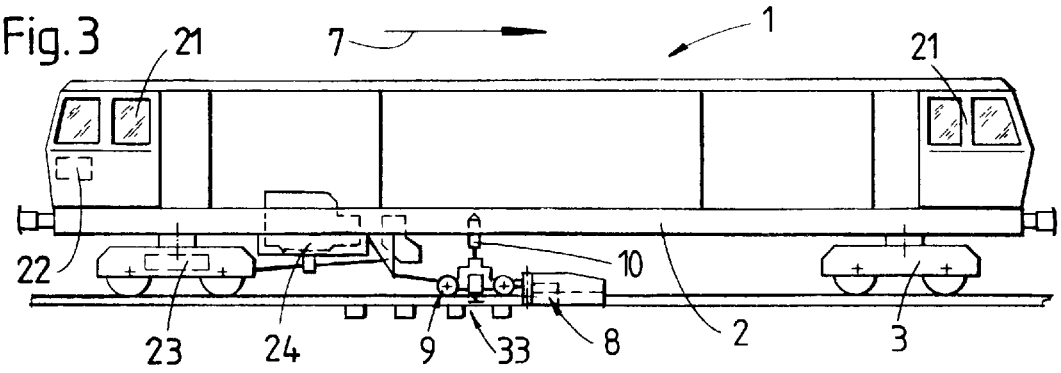
FIG. 3 shows a side elevational view of another embodiment of the machine according to the present invention.
Figure 4:
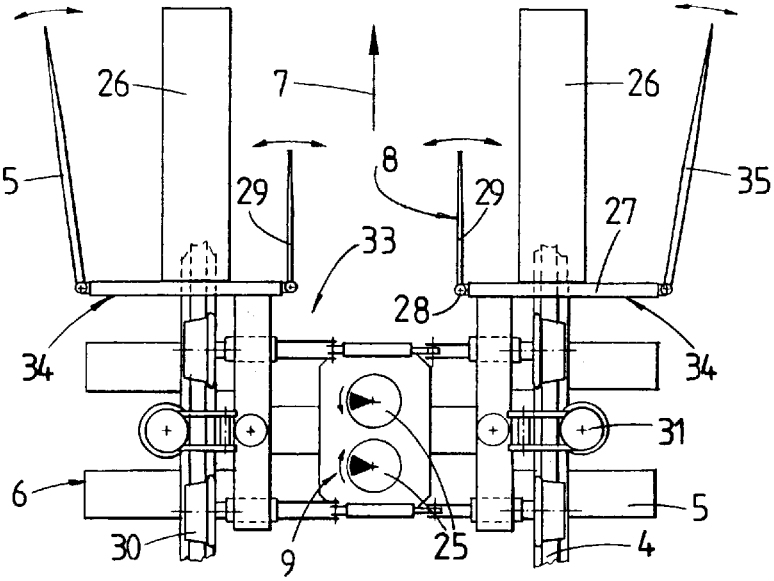
FIG. 4 is a simplified and enlarged top view of the structural unit of the machine of FIG. 3.
Figure 5:
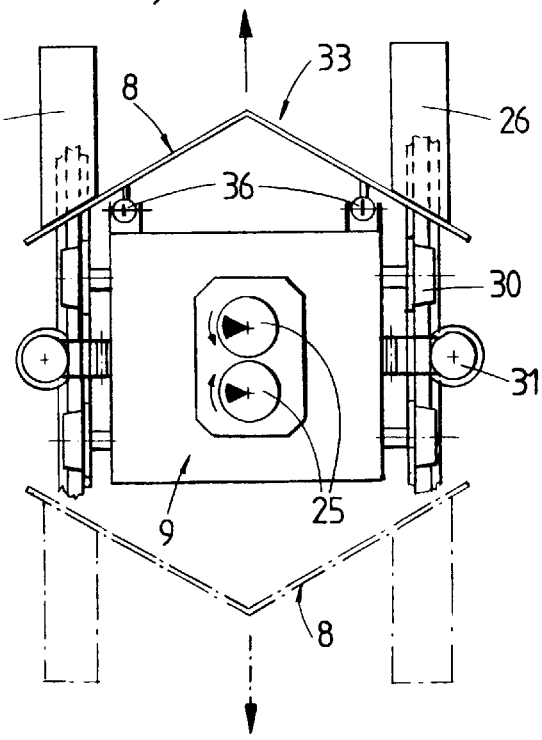
FIG. 5 is a like top view of a further embodiment of a structural unit combining a track stabilization assembly with ballast plow means.

Like parts operating in a like manner are designated in FIGS. 3–5 by the same reference numerals to simplify and shorten the description. In the embodiment of FIGS. 3 and 4, plow 8 of structural unit 33 is comprised of two plow units 34, each plow unit being associated with a respective track rail 4. Each plow unit has a ballast guide plowshare 27 extending perpendicularly to the longitudinal direction and affixed to track stabilization assembly 9 as well as rail tunnel 26. A central ballast guide plowshare 29 is pivoted to one end of plowshare 27 while a shoulder ballast guide plowshare 35 is pivoted to the opposite end of plowshare 27 to extend adjacent the ends of ties 5. Pivoting of plowshares 29 and 35 may be remote-controlled.

In the embodiment of FIG. 5, plow 8 is a V-shaped central plow, and drive 36 connects the plow to track stabilization assembly 9 for vertically adjusting the plow relative to the track stabilization assembly. As indicated in phantom lines, a further plow 8 may be spaced from first-named plow 8 in the longitudinal direction, track stabilization assembly 9 being positioned between the plows, and a further drive is provided for vertically adjusting the further plow relative to the track stabilization assembly independently of the vertical adjustment of the first-named plow.

What is claimed is:

1. A machine for compacting and shaping a ballast bed supporting a track having two rails, which comprises (a) a machine frame extending in a longitudinal direction and supported on undercarriages on the track for mobility in an operating direction, (b) a vertically adjustable track stabilization assembly including (1) vibrating means for generating horizontal oscillations extending transversely to the longitudinal direction and (2) flanged rollers engaging, and running on, the track rails, (c) drive means linking the track stabilization assembly to the machine frame for vertically adjusting the track stabilization assembly, and (d) a vertically adjustable plow for profiling the ballast, the plow being affixed directly to the track stabilization assembly to form a structural unit therewith.

2. The machine of claim 1, wherein the plow is arranged forwardly of the track stabilization assembly in the operating direction.

3. The machine of claim 1, further comprising a drive for vertically adjusting the plow relative to the track stabilization assembly.

4. The machine of claim 3, comprising a further plow spaced from the first-named plow in the longitudinal direction, the track stabilization assembly being positioned between the plows, and a further drive for vertically adjusting the further plow relative to the track stabilization assembly independently of the vertical adjustment of the first-named plow.

* * * * *

UNITED STATES PATENT AND TRADEMARK OFFICE

CERTIFICATE OF CORRECTION

PATENT NO. : 6,021,717
DATED : February 8, 2000
INVENTOR(S) : JOSEF THEURER

It is certified that error appears in the above-indentified patent and that said Letters Patent is hereby corrected as shown below:

On the title page, Item [73] please change "Australia" to --Austria--.

Signed and Sealed this

Fourteenth Day of November, 2000

*Attest:*

Q. TODD DICKINSON

*Attesting Officer*

*Director of Patents and Trademarks*